US005835026A

United States Patent [19]

Wicks et al.

[11] Patent Number: 5,835,026

[45] Date of Patent: Nov. 10, 1998

[54] COMMUTER INFORMATION PAGER

[75] Inventors: James E. Wicks, San Francisco, Calif.; Eduardo Sciammarella, Hoboken, N.J.

[73] Assignees: Sony Corporation, Japan; Sony Electronics, Inc., Park Ridge, N.J.

[21] Appl. No.: 810,809

[22] Filed: Mar. 6, 1997

[51] Int. Cl.[6] ..... G08G 1/12

[52] U.S. Cl. ..... 340/905; 340/311.1; 340/825.44; 340/990

[58] Field of Search ..... 340/311.1, 905, 340/990, 821.44

[56] References Cited

U.S. PATENT DOCUMENTS

| | | | |
|---|---|---|---|
| 4,415,065 | 11/1983 | Sandstedt . | |
| 4,792,803 | 12/1988 | Madnick et al. | 340/905 |
| 4,812,843 | 3/1989 | Champion, III et al. | 340/905 |
| 4,951,039 | 8/1990 | Schwendeman et al. . | |
| 5,173,688 | 12/1992 | DeLuca et al. . | |
| 5,206,641 | 4/1993 | Grant et al. | 340/905 |
| 5,331,431 | 7/1994 | Jasinski . | |
| 5,446,678 | 8/1995 | Saltzstein et al. . | |
| 5,452,356 | 9/1995 | Albert . | |
| 5,481,255 | 1/1996 | Albert et al. . | |
| 5,491,785 | 2/1996 | Robson et al. . | |
| 5,495,344 | 2/1996 | Callaway, Jr. et al. . | |
| 5,508,695 | 4/1996 | Nelson et al. . | |
| 5,535,428 | 7/1996 | King et al. . | |
| 5,649,289 | 7/1997 | Wang et al. | 455/31.3 |

*Primary Examiner*—Edward Lefkowitz
*Attorney, Agent, or Firm*—Ronald P. Kananen

[57] ABSTRACT

A novel paging system provides a apparatus and method for disseminating traffic condition information to subscribing commuters that is specific to the route or routes traveled by the commuter. Commuters provide the paging system service provider with a description of the routes along which they commute. The service provider then compiles traffic condition information and transmits traffic reports to the subscribing commuters. The reports are specific to the route traveled by each commuter.

12 Claims, 3 Drawing Sheets

COMMUTER INFORMATION PAGER

FIELD OF THE INVENTION

The present invention relates generally to the field of wireless pagers. More particularly, the present invention relates to an application of wireless pager technology as a means for receiving information regarding traffic conditions.

BACKGROUND OF THE INVENTION

Portable radio receivers and transceivers, such as wireless pagers, have become increasingly popular as a means of communication. Pagers are typically carried by users who wish or need to receive communications when they are away from a telephone or computer, or are unable to predict where they may be reached at a given time.

In general, the user of a pager purchases the unit and enters into a contract with a service provider. As shown in FIG. 1, when someone 12 wishes to page a particular user, they contact the user's service provider 11, identify the user to be paged (perhaps with a personal identification number), and may give a message to the service provider 11 that is to be broadcast to the user's pager 15.

The service provider 11 maintains a network of radio transceiver base stations 13, 14 which are spread throughout the service area covered by the service provider. The transmitting base stations 13 are distributed so that transmissions from at least one base station can be received by a pager 15 anywhere in the service area.

In a simplistic system, when the service provider 11 receives a request to page a user 15, the page is broadcast by all the base stations 13 in the system. Thus, if the pager 15 is located anywhere in the service area, it will receive the page. The pager 15 will then alert the user that a page has been received with, for example, an audible or vibratory alert signal.

In a more sophisticated system, the pager 15 may have the capability to not only receive a transmission from the service provider's system, but also to transmit an answer back to the system. This is referred to as two-way paging.

With these advances, the usefulness of pagers as a means of communication has expanded rapidly. Service providers have encouraged this expansion by experimenting with pagers as a means to disseminate information of interest to pager users. For example, as described in U.S. Pat. No. 5,508,695 to Nelson et al., incorporated herein by reference, a one-way pager system is used to relay sports or financial information to a pager user who has contracted with the service provider for that service.

However, there are many potential, undiscovered applications of pager technology which may provide pager users with, as yet unheard of, abilities to communicate. This is particularly true of the developing two-way pager systems. Accordingly, there is a need for improved methods and applications of pager technology to meet the information, recreation and communication demands of pager users.

Congested traffic conditions are a perennial problem for those who live in large urban areas. The problem is particularly acute for those who regularly commute in the high traffic volume of the rush hour. Frequently an alternate, less congested route may be taken if a commuter is alerted in advance of particular problem area. Accordingly, there is a need for an improved means of informing commuters about problem traffic areas along regularly traveled routes.

SUMMARY OF THE INVENTION is an object of the present invention to meet the above identified needs and others. More particularly, it is an object of the present invention to provide a novel pager and paging system and methods of using the same to provide commuters with traffic pattern information.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve the stated and other objects of the present invention, as embodied and described below, the invention may encompass a paging system for disseminating traffic condition information having: a commuter route information database containing route information for at least one commuter; a traffic information database containing traffic information; a central processor for accessing the route and traffic information databases; and at least one transmitter.

The processor compares the route and traffic information, prepares a traffic report specific to the route and transmits the report. The report comprises a description of the severity, location and type of at least one actual or potential traffic problem.

The commuter route information database may further include an indication of a time at which the at least one commuter usually commutes. The report is then transmitted at that time.

The paging system of the present invention may further include at least one receiver for receiving a transmission from a pager. The traffic report is then transmitted in response to a signal received from a pager.

The present invention also encompasses a pager for receiving traffic information having: a controller; a display; an antenna; and scroll keys. The pager receives, through the antenna, a traffic report from a paging system at least a portion of which is displayed by the controller on the display. The display of the report may be controlled by actuating the scroll keys.

The pager of the present invention may further include: a traffic report request icon; a selection key; and a cursor on the display which moves in response to the actuation of the scroll keys. The pager transmits a signal to the paging system requesting a traffic report in response to the selection of the icon, indicated by the actuation of the selection key. Lastly, the present pager may include a mounting device for mounting the pager in an automobile.

The present invention also encompasses a method of using a paging system for disseminating traffic condition information by: compiling a commuter route information database containing route information for at least one commuter; compiling a traffic information database containing traffic information; accessing the route and traffic information databases with a processor; with the processor, comparing the route and traffic information to prepare a traffic report specific to the route; and transmitting the report to a pager with at least one transmitter. The present method may further include describing in the report the location, type and severity of at least one actual or potential traffic problem.

The compiling of a commuter route information database may further include identifying a time at which the at least one commuter usually commutes. The transmission of the traffic report is then timed to coincide with that time. Otherwise, the present method may include: receiving a signal from a pager with at least one receiver; and transmitting the report in response to the signal.

Finally, the present invention encompasses a method of using a pager for receiving traffic information by: providing a controller; receiving transmissions of traffic information from a paging system with an antenna; displaying the traffic information on a display which is controlled by the controller; and controlling the display with scroll keys.

The present method continues by displaying a traffic report request icon on the display; selecting the icon with the scroll keys and a selection key; and transmitting a signal to the paging system requesting a traffic report in response to the selection of the icon. The present method may also include mounting device the pager in an automobile.

BRIEF DESCRIPTION OF THE DRAWINGS

The accompanying drawings illustrate the present invention and are a part of the specification. Together with the following description, the drawings demonstrate and explain the principles of the present invention. In the drawings.

DETAILED DESCRIPTION OF THE PREFERRED EMBODIMENT

Using the drawings, the preferred embodiment of the present invention will now be explained. Under the principles of the present invention, pager technology can be adapted to provide a means and method to allow commuters to receive more timely and relevant information regarding traffic patterns and congestion.

Figure 1:
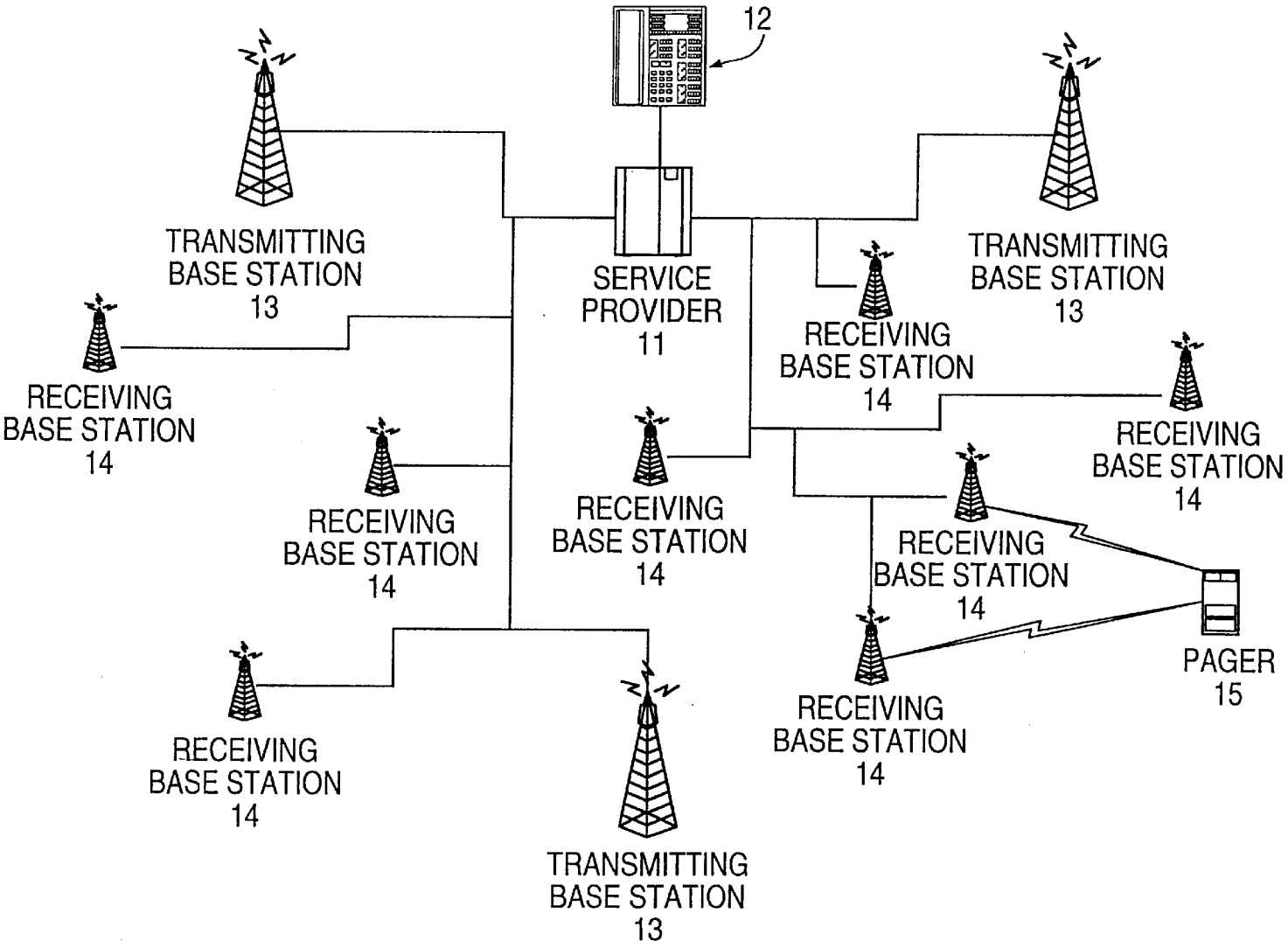
FIG. 1 is a schematic diagram of a conventional two-way paging network with which the present invention may be practiced.
Figure 2:
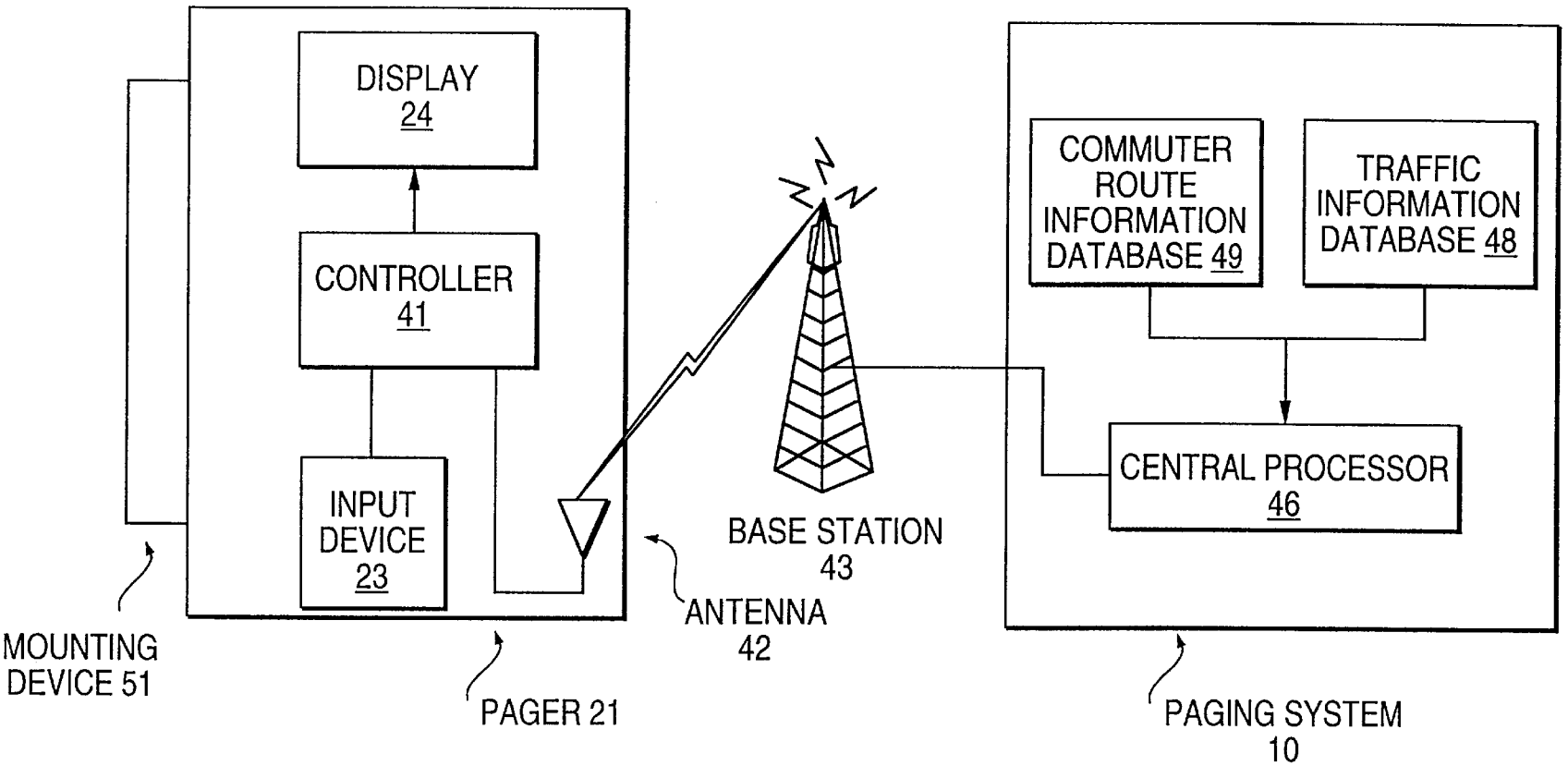
FIG. 2 is a diagram of the key components of the system of the present invention.

FIG. 2 illustrates the key components of the pager and paging system under the principles of the present invention. As shown in FIG. 2, pager 21 is provided with a display 24, e.g., a liquid crystal display, and an input device 23. Pager 21 also has a controller 41, and an antenna 42. The paging system 10 of the present invention is provided with a central processor 46, a commuter route information database 49 and a traffic information database 48.

When a commuter contracts with the paging system service provider for the commuter information service, the service provider will obtain from the commuter a description of the commuter's typical route. If there are several available routes, the service provider may obtain a description of each from the commuter. The commuter's route will most likely take him or her to work, but could alternatively be any route regularly traveled by the commuter for any reason.

The information detailing the route(s) traveled by subscribing commuters will be compiled in the commuter route information database 49. Associated with each commuter's route information will be an identification of that commuter and his or her pager.

The service provider who operates the paging system 10 will also compile a database 49 of traffic information, i.e., information regarding traffic conditions and patterns. This information may be gathered, for example, by the service provider from newscasts or a radio receiver scanning frequencies used by police and other emergency services. Alternatively, the service provider may employ a helicopter or airplane to over-fly the area and report on traffic conditions.

The central processor 46 of paging system 10 will access the route information in database 49 and the traffic information in database 48. It will match the location of reported traffic congestion and potential traffic problems with the routes traveled by subscribing commuters.

Using base station 43, the central processor 46 will then transmit traffic reports to subscribing commuters that are specific to each commuter's route. The reports may state the location, type and severity of actual and potential traffic problems along each commuter's route.

The pager 21 receives the transmitted traffic report from the paging system 10 through antenna 42. The controller 41 displays the transmitted report on display 24. Accordingly, the commuter may use the information displayed on pager 21 to plan or reroute his or her commute. This may save the commuter considerable time that would otherwise by lost sitting in traffic.

Pager 21 may also be provided with a mounting device 51. The mounting device 51 can take a wide variety of forms known to those skilled in the art. The mounting device 51 allows the pager 21 to be secured to a car's sun-visor, dashboard, steering wheel, etc., so that is can be conveniently referred to by the commuter during the commute.

Figure 3:
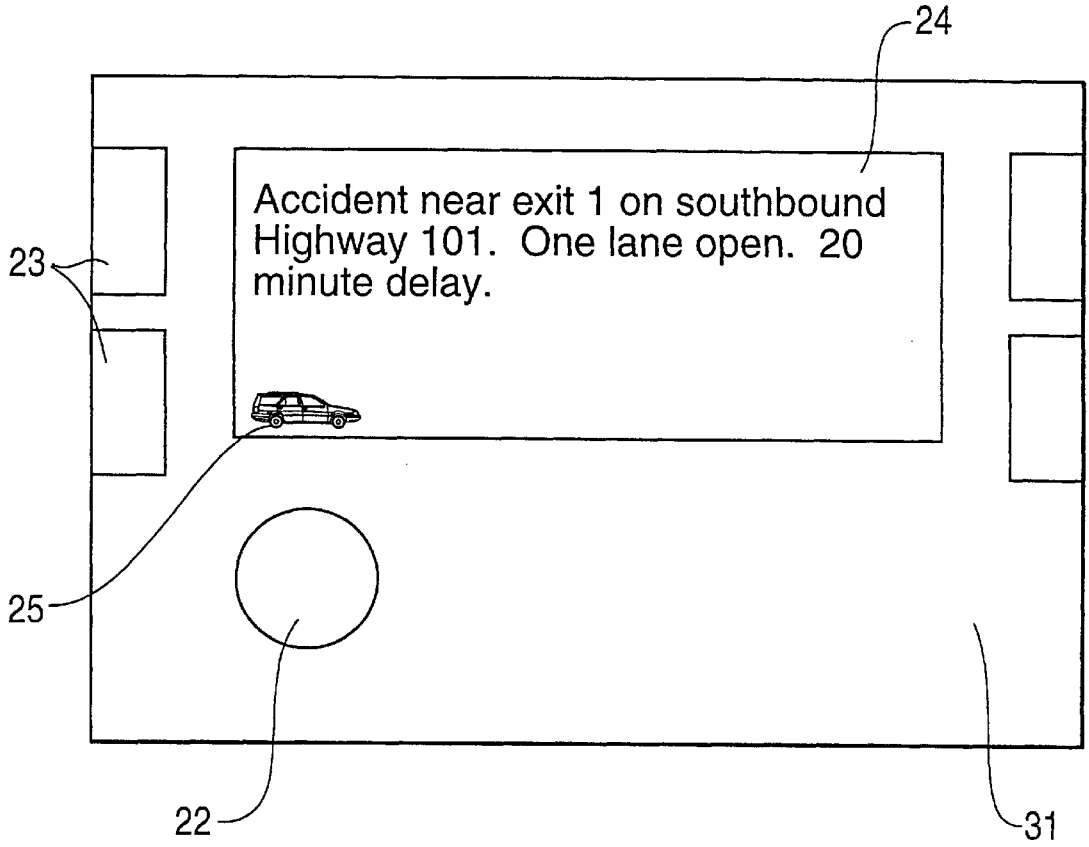
FIG. 3 is a diagram of a pager according to the principles of the present invention.

FIG. 3 illustrates a pager 21 according to the principles of the present invention. The pager 21 has, as described above, a display 24. The input device of the pager 21 may include a number of scroll keys 23 and a selection key 22.

As described above, a pager and paging system may provide for one- or two-way paging. It should be noted here that the present invention may be practiced with either type of paging system. As described above, the present invention may be used on a one-way paging system to spare the expense of a more sophisticated two-way system.

If the present invention is practiced with a one-way paging system, the pager user may, in addition to route information, indicate to the service provider during what times the commuter travels the described route. Under such a system, the paging system will transmit relevant traffic condition information to the commuter's pager during those times.

Alternatively, if the present invention is practiced on a two-way paging system, the commuter can signal the paging system 10 to commence transmitting relevant traffic reports. As shown in FIG. 3, an icon 25 may be displayed on display 24.

When the commuter wishes to receive traffic reports, he or she uses scroll keys 23 to move a cursor (not shown) on display 24. The cursor is moved to highlight icon 25. The commuter then presses the selection button 22. Pager 21 then transmits a signal to the paging system 10 to commence delivery of traffic reports relevant to the commuter's route.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A paging system for disseminating traffic condition information comprising:

a commuter route information database containing route information for at least one commuter;

a traffic information database containing traffic information and an indication of a time of day at which said at least one commuter usually commutes;

a central processor for accessing said route and traffic information databases; and at least one transmitter;

wherein said processor automatically compares said route and traffic information, prepares a traffic report specific to said route and transmits said report at said time of day at which said at least one commuter usually commutes wherein said preparation and transmission of the traffic report is automatically performed without prompting from said at least one subscriber.

2. A paging system as claimed in claim 1, wherein said report comprises a description of the severity of at least one actual or potential traffic problem.

3. A paging system as claimed in claim 1, wherein said report comprises a description of a location of at least one actual or potential traffic problem.

4. A paging system as claimed in claim 1, wherein said report comprises a description of a type of at least one actual or potential traffic problem.

5. A paging system as claimed in claim 1, further comprising a pager for receiving traffic information comprising:

a controller;

a display an antenna; and scroll keys;

wherein said pager receives, through said antenna, a traffic report from a paging system at least a portion of which is displayed by said controller on said display;

wherein said display of said report may be controlled by actuating said scroll keys.

6. A paging system as claimed in claim 5, wherein said pager further comprises a mounting device for mounting the pager in an automobile.

7. A method of using a paging system for disseminating traffic condition information comprising:

compiling a commuter route information database containing route information for at least one commuter and an indication of a time of day at which said at least one commuter usually commutes;

compiling a traffic information database containing traffic information;

automatically preparing a traffic report by accessing said route and traffic information databases with a processor, and comparing said route and traffic information to prepares said traffic report specific to said route, wherein said preparation of said traffic report is conducted automatically at said time of day at which said at least one commuter usually commutes; and transmitting said report to a pager wherein said preparation and transmission of the traffic report is automatically performed without prompting from said at least one subscriber.

8. A method as claimed in claim 7, further comprising describing in said report the severity of at least one actual or potential traffic problem.

9. A method as claimed in claim 7, further comprising describing in said report a location of at least one actual or potential traffic problem.

10. A method as claimed in claim 7, further comprising describing in said report a type of at least one actual or potential traffic problem.

11. A method as claimed in claim 10, further comprising using a pager having a controller, an antenna, a display and scroll keys for receivng traffic information by:

receiving transmissions of traffic information from a paging system with said antenna;

displaying said traffic information on said display which is controlled by said controller; and controlling said display with said scroll keys.

12. A method as claimed in cliam 11, further comprising mounting device for said pager in an automobile.

* * * * *